US005090139A

United States Patent [19]

Germann

[11] Patent Number: 5,090,139

[45] Date of Patent: Feb. 25, 1992

[54] SKI BOOT WITH A HEIGHT-ADJUSTABLE FOOT-BED

[75] Inventor: Andreas Germann, Kreuzlingen, Switzerland

[73] Assignee: Raichle Sportschuh AG, Kreuzlingen, Switzerland

[21] Appl. No.: 568,250

[22] Filed: Aug. 16, 1990

[30] Foreign Application Priority Data

Aug. 18, 1989 [CH] Switzerland ..... 03019/89

[51] Int. Cl.[5] ..... A43B 5/04

[52] U.S. Cl. ..... 36/117; 36/119

[58] Field of Search ..... 36/117, 118, 119, 120, 36/121

[56] References Cited

U.S. PATENT DOCUMENTS

| | | | |
|---|---|---|---|
| 3,828,448 | 8/1974 | Leonildo | 36/119 |
| 4,430,810 | 2/1984 | Bente | 36/121 X |
| 4,523,395 | 6/1985 | Borsoi | 36/119 |
| 4,739,563 | 4/1988 | Guggenberger et al. | 36/117 |
| 4,765,070 | 8/1988 | Chemello et al. | 36/117 |
| 4,962,594 | 10/1990 | Marega et al. | 36/120 X |

FOREIGN PATENT DOCUMENTS

| | | | |
|---|---|---|---|
| 0073989 | 3/1983 | European Pat. Off. | 36/117 |
| 0316605 | 5/1989 | European Pat. Off. . | |
| 2953208 | 9/1980 | Fed. Rep. of Germany . | |
| 3706113 | 9/1987 | Fed. Rep. of Germany . | |

*Primary Examiner*—Paul T. Sewell
*Assistant Examiner*—Ted Kavanaugh
*Attorney, Agent, or Firm*—Oliff & Berridge

[57] ABSTRACT

On the shaft (14) of the ski boot (12), a spindle (40) is mounted in the heel area (10). The spindle runs parallel to the sole (16) and at right angles to the longitudinal direction (B) of the boot. On the spindle (40), two opposite-running threads (38, 38') are formed, on each of which a support member (32) is located. By means of rotation of the spindle (40) from outside the ski boot (12), the support members (32) are moved towards or away from one another. This relative movement of the support members (32) is transformed, via inclined surfaces (30) on support ribs (26) of the foot-bed (22), into a movement of the foot-bed (22) in the direction of the arrow (A). By means of an asymmetrical arrangement of the two support members (32) in relation to the longitudinal center plane of the boot, a transverse inclination of the foot-bed (22) can be set.

15 Claims, 3 Drawing Sheets

SKI BOOT WITH A HEIGHT-ADJUSTABLE FOOT-BED

BACKGROUND OF THE INVENTION

The present invention relates to a ski boot with a height-adjustable foot-bed. Such a ski boot is known, for example, from EP-Al 0,213,520 and the corresponding U.S. Pat. No. 4,739,563. In this ski boot, under the foot-bed in the area of the heel of the ski boot, a wedge-shaped support member is arranged, which is in working connection via a Bowden cable with a hydraulic drive unit which is arranged on a rear shaft part which is pivotably mounted on the shaft of the ski boot. By means of the drive unit, the support member is displaceable backwards and forwards in the longitudinal direction of the boot. In this connection, the inclined surface of the wedge-shaped support member, which surface is inclined in the direction of movement of the support member and rises in the direction towards the rear end of the boot, slides on a corresponding surface of the foot-bed. The movement of the wedge-shaped support member in the longitudinal direction of the boot consequently results in a corresponding raising or lowering of the foot-bed in the area of the heel. The device for adjusting the height of the foot-bed of this ski boot is complicated and costly in structure.

SUMMARY OF THE INVENTION

It is thus one object of the present invention to produce a ski boot of the generic type, which has a simple device for adjusting the height of the foot-bed and which makes possible further adjustment possibilities for the foot-bed.

This object is achieved by means of the features of the present invention. According to the invention, two support members, which are mutually offset in a direction transverse to the longitudinal direction of the boot and displaceable in this direction, as well as an inclined surface allocated to each support member, are provided. By means of the lateral offset, the two support members impart an extremely good lateral tilting stability to the foot bed irrespective of the height adjustment. Furthermore, an adjustable transverse inclination of the foot-bed, a so called foot-bed canting, is made possible. By means of displacing only one support member or asymmetrical or lateral displacement of both support members, the foot-bed is rotated about an axis which runs essentially parallel to the longitudinal direction of the boot.

BRIEF DESCRIPTION OF THE DRAWINGS

The invention will be described below in greater detail with reference to an exemplary embodiment which is represented in the drawings, in which.

DETAILED DESCRIPTION OF THE PREFERRED EMBODIMENTS

Figure 1:
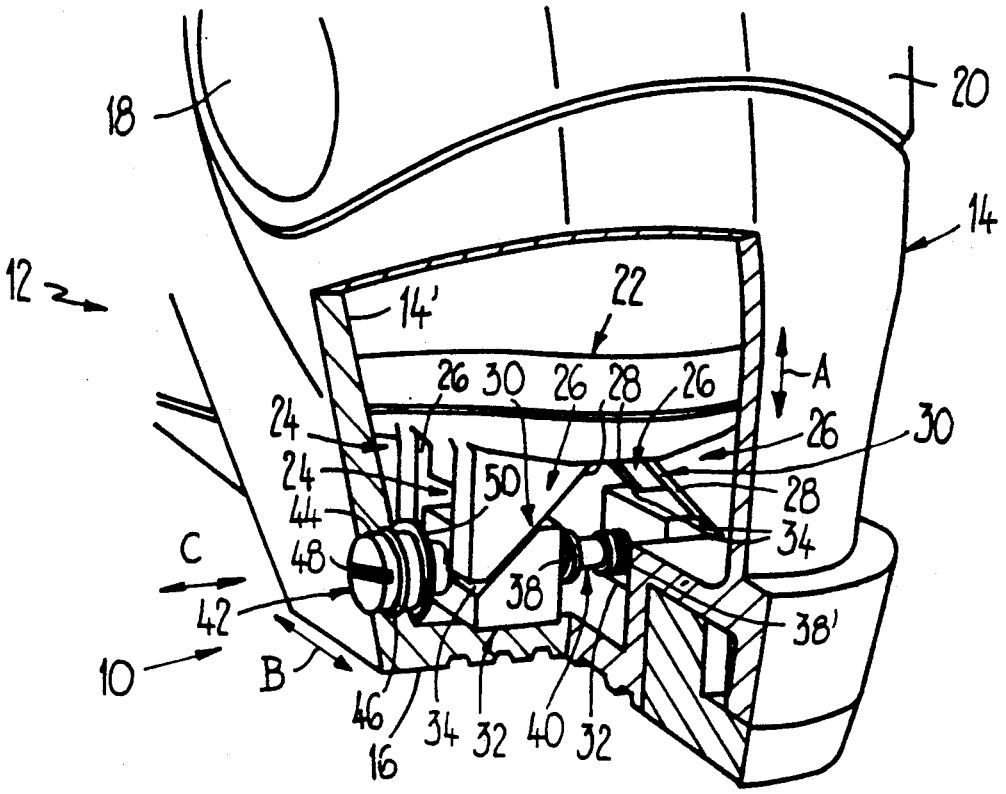
FIG. 1 shows the heel area of a ski boot in a perspective and cut-open representation.

FIG. 1 shows the heel area 10 of a ski boot 12 in a perspective representation from behind, partially in section. The ski boot 12 has a shaft 14 and a sole 16 made of plastic. On the shaft 14, in the area 18 of the ankle, a rear shaft part 20 is pivotably mounted. On the inside of the ski boot 12, a foot-bed 22, likewise made of plastic, is provided, which is height-adjustable essentially at right angles to the sole 16 in a direction A in the heel area 10. Upon adjustment of the height of the foot-bed 22, the inclination of the foot-bed 22 consequently also changes as seen in the longitudinal direction B of the boot.

In the heel area 10, support rib pairs 24, which are separated from one another in the longitudinal direction B of the boot, are formed onto the foot-bed 22. Each support rib pair 24 has two wedge-shaped support ribs 26 which are designed symmetrically in relation to the longitudinal center plane of the boot (see also FIGS. 3 to 5). An inclined part surface 28, which is inclined as seen in a direction C parallel to the sole and at right angles to the longitudinal direction B of the boot, is formed onto each support rib 26. The part surfaces 28 run in a direction parallel to the longitudinal direction B of the boot and, as seen in direction A, upwards towards one another. The two part surfaces 28 on the mutually corresponding support ribs 26 of the two support rib pairs 24 form an inclined surface 30.

The mutually corresponding support ribs 26 of the two support rib pairs 24 each bear with their part surfaces 28 against a support member 32. The two support members 32 are essentially of cuboid design, arranged in a mutually offset manner in direction C and adjustable in their mutual separation in direction C, as is described in greater detail below. The support ribs 26 bear with their part surfaces 28 against support surfaces 34 which are formed on the support members 32. The two support surfaces 34 of a support member 32 are separated from one another by a retaining nose 36 which engages in an area between the two support ribs 26. By these means, the foot-bed 22 is accurately positioned in the longitudinal direction B of the boot by the retaining noses 36 and the support ribs 26. The two support members 32 are located as running nuts on a spindle 40 which is designed with two opposite-running threads 38, 38' of identical pitch and runs in the direction of the arrow C. The spindle 40 is rotatably mounted in the shaft 14 and is arranged above the sole 16 in such a manner that the support members 32 are in contact with the sole 16 but can slide on it when the spindle 40 is rotated.

At that end area of the spindle 40 which is visible in FIG. 1, the spindle has a head 42 which is mounted in a cylindrical passage 44 in the shaft 14. In the area of the passage 44, the head 42 bears an O-ring 46 in order to prevent the penetration by snow and water into the inside of the ski boot 12. On the end face, a slot 48 is formed onto the head 42 in order to rotate the spindle 40 from the outside of the ski boot 12 with the aid of a screwdriver or a coin. On the inside of the ski boot 12, the head 42 has a disk-shaped enlargement 50 which bears against the inner surface 14' of the shaft 14 in order to rigidly position the spindle 40 in the direction of the arrow C.

Figure 2:
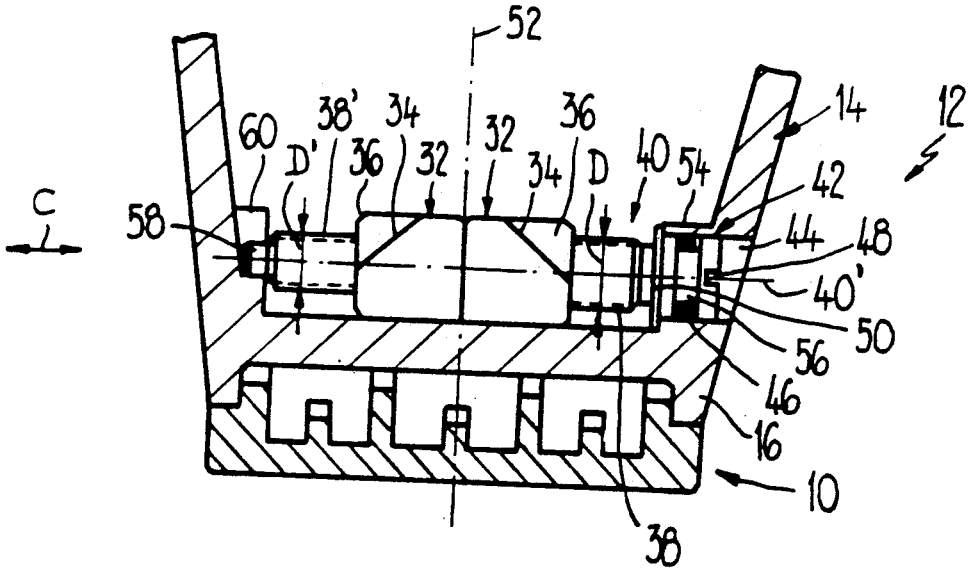
FIGS. 2–5 show a vertical cross-section through the heel area of the ski boot.

FIG. 2 shows a vertical cross-section through the heel area 10 of the ski boot 12, which cross-section runs at right angles to the longitudinal center plane 52, indicated in dot-dash lines, of the boot. On the spindle 0 40, the axis 40' of which is indicated in dot-dash lines and runs at right angles to the longitudinal center plane 52 of the boot, the two support members 32 are located. These touch one another in the area of the longitudinal center plane 52 of the boot. The two support members 32 bear against the sole 16 and on them the support surfaces 34 are formed, only one of these being visible in each case, which are separated from one another by a retaining nose 36. For greater clarity, the foot-bed 22 is not shown in FIG. 2.

In the area of the head 42 of the spindle 40, the shaft 14 has, projecting in the direction towards the inside of the boot, a thickening 54 in which the passage 44 is designed. The disk-shaped enlargement 50 of the head 42 bears against that end face of the thickening 54 which faces towards the inside of the boot. In the area of the passage 44, the head 42 has a peripheral groove 56 in which the O-ring 46 is placed. The externally accessible slot in the head 42 is indicated by 48. At the end area removed from the head 42, the spindle 40 has a journal 58 by means of which it is rotatably mounted in a bearing member 60 which is formed onto the shaft 14. The spindle 40 is consequently held rigidly in the direction of the arrow C and rotatably mounted about the axis 40'.

Figure 3:
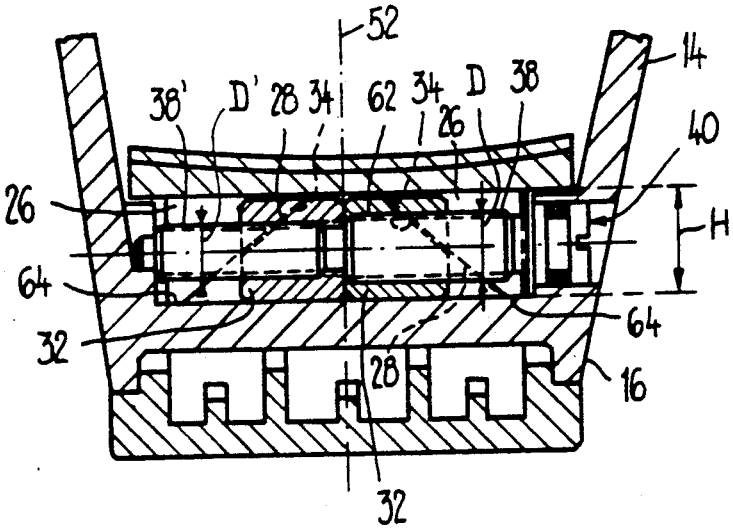
Figure 4:
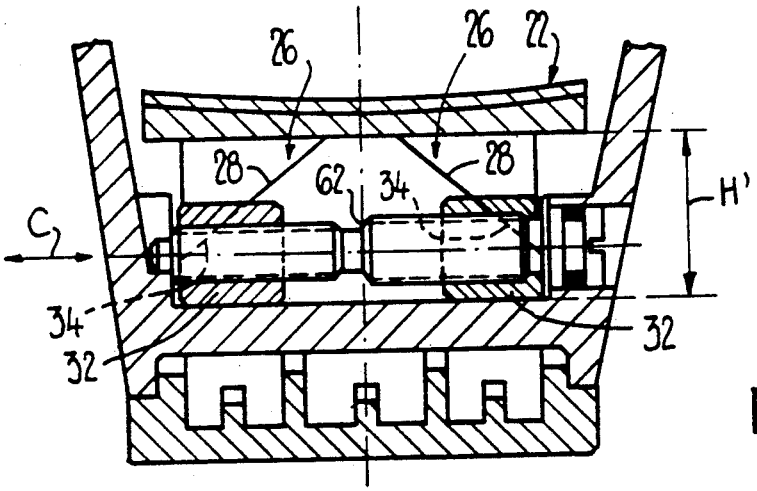
Figure 5:
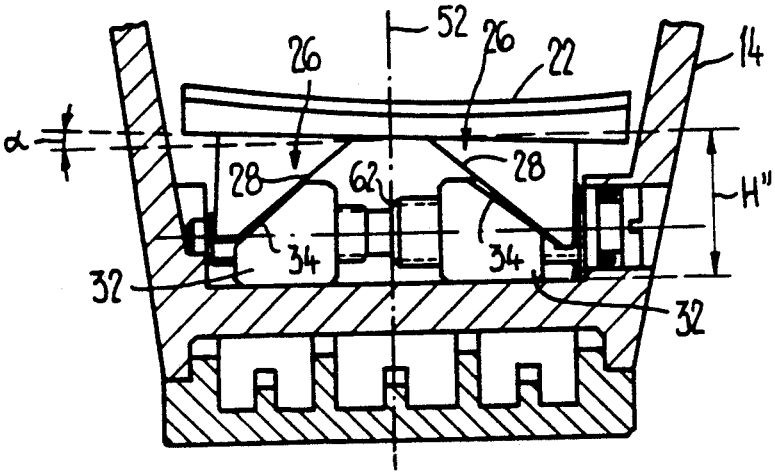

As can be seen in particular also from FIGS. 3 to 5, the spindle 40 has, in the area of the threads 38, 38', a different diameter D or D' respectively; for greater clarity, this is indicated only in FIGS. 2 and 3 by means of double arrows. The change in diameter D—D' takes place in a stepped manner in the area of the longitudinal center plane 52 of the boot so that this transition forms a stop 62 for the support member 32 located on the thread 38' with the smaller diameter D'. The structure of the shaft 14, of the sole 16, of the support members 32 and of the spindle 40 is designed exactly the same in FIGS. 3 to 5 as in FIGS. 1 and 2. These parts are therefore only described and mentioned in connection with these FIGS. 3 to 5 to the extent that is necessary for comprehension.

In FIG. 3, the two support members 32 touch one another in the area of the longitudinal center plane 52 of the boot and the foot-bed 22 is in its lower end position which is indicated by the double arrow H. At the same time, the support ribs 26 bear with their flattened free ends 64 against the inner wall of the sole 16. At the same time, the part surfaces 28 of the support ribs 26 are slightly separated from the support surfaces 34 of the support members 32.

In FIG. 4, the support members 32 are shown at maximum separation from one another and symmetrical in relation to the longitudinal center plane 52 of the boot in the direction of the arrow C. At the same time, the support ribs 26 bear with their part surfaces 28 against the support surfaces 34 of the support members 32, and the foot-bed 22 is raised to the maximum height which is indicated by H'. The foot-bed 22 has at the same time no transverse inclination in the plane of projection.

In the position of the support members 32 which is shown in FIG. 5 and in which members 32 are situated in the central area between the longitudinal center plane 52 of the boot and the shaft 14, the foot-bed 22 is raised to a height H'' which lies between the minimum height H and the maximum height H'. It is to be noted, however, that the distance between the longitudinal center plane 52 of the boot and the support member 32 shown on the left in FIG. 5 is greater than the distance between the longitudinal center plane 52 of the boot and the support member 32 shown on the right. The result of this is that the foot-bed 22 is transversely inclined at an angle $\alpha$. At the same time, the part surfaces 28 of the support ribs 26 are supported essentially linearly on the relevant ends of the support surfaces 34 of the support members 32. This leads to great surface pressing in the area of the support which leads to good tilting stability of the foot-bed 22. Between the heel area 10 and the toe of the boot, the foot-bed 22 bears against the inner surface 14' of the shaft 14 so that the foot-bed cannot be displaced in the direction of the arrow C.

Figure 6:
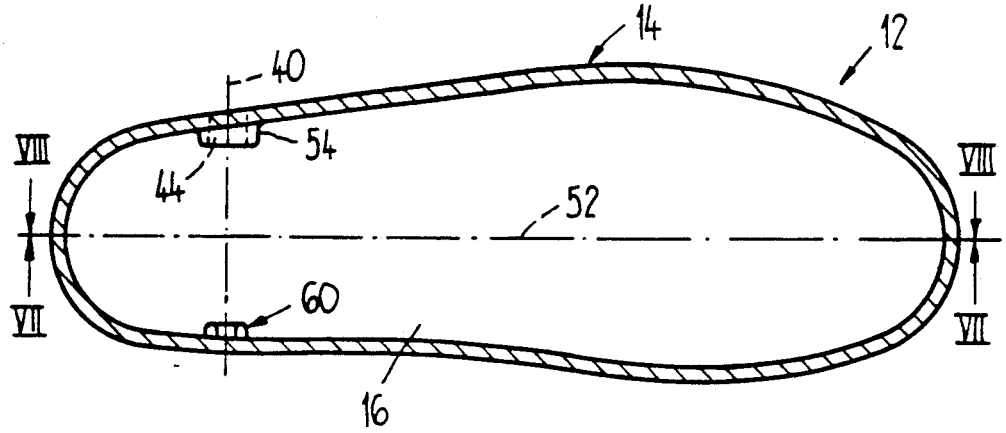
FIG. 6 shows a horizontal cross-section above the sole through the ski boot.
Figure 7:
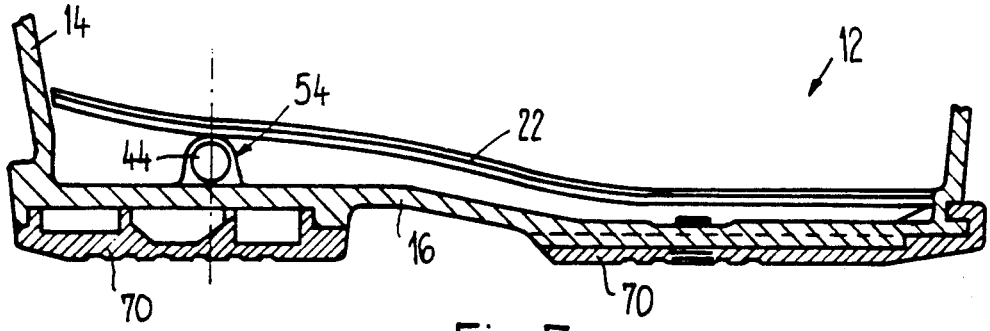
FIGS. 7 and 8 show longitudinal cross-sections through the ski boot in the area of the sole along the lines VII—VII and VIII—VIII.
Figure 8:
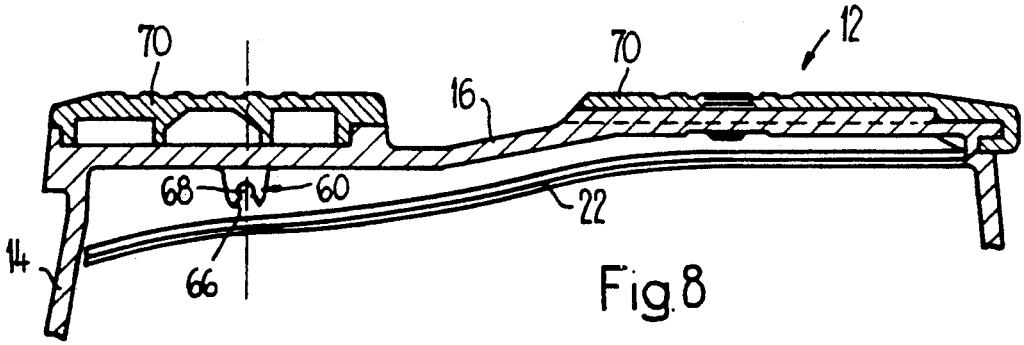

In FIG. 6, the ski boot 12 is shown in a horizontal cross-section which runs above the thickening 54. The thickening 54 as well as the bearing member 60, which lies symmetrically opposite the former in relation to the longitudinal center plane 52 of the boot, are formed onto the shaft 14 and integrally connected to the sole 16. The axis of the spindle 40 (not shown in this figure) is indicated by 40'. FIGS. 7 and 8 show a vertical cross-section in the longitudinal center plane 52 of the boot through the lower part of the ski boot 12, the foot-bed 22 being indicated in a simplified schematic manner. The latter bears against the sole 16 in particular in the area of the ball of the foot. As FIGS. 6 and 8 in particular show, the bearing member 60 has a V-shaped, groove-shaped guide part 66 which is open at the top and opens into a cylindrical bearing part 68 for the journal 58. Sole coatings 70 are attached in a known manner to the sole 16.

In mounting the support members 32 on the spindle 40, the position of the support members 32 is accurately defined symmetrically in relation to the longitudinal center plane 52 of the boot by the stop 62. First the support member 32 shown on the left in FIG. 1 and on the right in FIGS. 2 to 5 is screwed onto the thread 38 which is adjacent to the head 42 and has the greater diameter D. Subsequently the other support member 32 is put onto the thread 38' with the smaller diameter D' and screwed in until it touches the stop 62. Now the support member 32 screwed on first is moved in a direction towards the stop 62 until the two support members 32 touch one another. The spindle 40, with the support members 32 located on it in this position, is inserted with the head 42 into the passage 44 in the shaft 14 from the inside of the ski boot so that the disk-shaped enlargement 50 comes to bear against the thickening 54. Subsequently the journal 58 is pushed through the guide part 66 into the bearing part 68, as a result of which the spindle 40 is held securely and bed 22 is introduced into the inside of the ski boot 12 and lowered onto the support members 32 in such a manner that the support ribs 26 engage around the retaining noses 36. As the two opposite-running threads 38, 38' have the same pitch, the support members 32 are now, when the spindle 40 is rotated, displaced synchronously in relation to one another and away from or towards one another symmetrically in relation to the longitudinal center plane 52 of the boot.

For the adjustment of the desired height of the foot-bed 22, the spindle 40 is rotated in the relevant direction, for example clockwise, by means of a screwdriver or a coin, as a result of which the two support members 32 move away from one another in the direction of the arrow C synchronously in relation to one another and, in the case of the opposite direction of rotation, for example anti-clockwise, towards one another. This movement is transformed via the inclined surfaces 30 into a respective raising or lowering of the foot-bed in the direction of the arrow A. At the same time, the tilting stability of the foot-bed 22 is maintained at any height of the foot-bed 22, since the contact surfaces between the part surfaces 28 and the support surfaces 34 travel further away from one another the more the foot-bed 22 is raised. The gearing down of the rotary movement of the spindle 40 via the opposite-running threads 38, 38' to the support members 32 and via their support surfaces 34 to a raising or lowering movement of the foot-bed 22 makes possible the adjustment of the height of the foot-bed 22 without the skier having to remove the ski boot 12. Furthermore, this gearing ratio brings about a self-locking so that the height of the foot-bed 22, once adjusted, is maintained without voluntary rotation of the spindle 40 from outside. This locking is additionally supported by the friction of the O-ring 46 on the passage 44 and on the head 42.

To set a transverse inclination of the foot-bed, the procedure is as follows. First the foot-bed 22 is removed from the inside of the ski boot 12. Then the support members 32 are brought into a position approximately in the center between the longitudinal center plane 52 of the boot and the shaft 14 by corresponding rotation of the spindle 40. Subsequently the journal 58 is lifted out of the bearing member 60 by means of a screwdriver or another tool. One support member 32 can now be brought closer to the longitudinal center plane 52 or moved away from it by turning on the corresponding thread. Subsequently the journal 58 is inserted into the bearing member 60 again. The two support members 32 are now no longer arranged symmetrically in relation to the longitudinal center plane 52, as is shown in FIG. 5. Upon the subsequent insertion of the foot-bed 22 into the inside of the ski boot 12 and lowering of the support ribs 26 onto the support members 32, a transverse inclination of the foot-bed 22 now takes place. By subsequent rotation of the spindle 40, the height of the foot-bed 22 can now be adjusted while maintaining the transverse inclination.

It is of course also conceivable to provide cylindrical support members. These are located, for example, with their longitudinal axis running at right angles to the spindle 40, on the thread 38 or 38' At the same time, the support ribs 26 bear with their part surfaces 28 against the outer surface of the cylindrical support members. It is also possible to provide spherical support members, a flattening advantageously being formed on these in order to prevent a rotation of the support members in relation to the sole.

It would also be possible only to provide inclined surfaces on the support members, on which the foot-bed is supported via an appropriate, for example cylindrical, element. For the sake of completeness, it may also be mentioned that the inclined surfaces could be formed on the sole or on the shaft with the movement of the support members in the direction of the arrow C being transformed by these inclined surfaces into a movement in the direction of the arrow A. In this case, the support members move together with the foot-bed. Finally it may also be mentioned that different operating elements could also be provided for the movement of the support members.

What is claimed is:

1. A ski boot with a height-adjustable foot-bed, comprising:

a boot body including a shaft and a sole;

a foot-bed; and a foot-bed support means; wherein said foot-bed is arranged within the boot body to bear in a heel area thereof against said support means, said support means comprising camming means displaceable within the boot body by displacement means operable from outside the boot body for adjustment of the height of the foot-bed, said camming means comprising a first and a second support element, the two support elements mutually offset and displaceable in a direction transverse to a longitudinal direction of the boot body, each support element having a camming surface which cooperates with a corresponding camming surface attached to said foot-bed, at least one of each camming surface of the camming means and each camming surface attached to the foot-bed comprising an inclined surface attached to the boot-bed comprising an inclined surface inclined in a direction of displacement of the support elements;

wherein the support members can be adjusted into an asymmetrical position in relation to the longitudinal center plane of the boot for providing transverse inclination to the foot-bed.

2. The ski boot as claimed in claim 1, wherein the support elements are displaceable synchronously towards one another and away from one another.

3. The ski boot as claimed in claim 1, wherein the support elements are in working connection with a common operating element of the displacement means.

4. The ski boot as claimed in claim 1, wherein the support elements are located on a common guide.

5. The ski boot as claimed in claim 1, wherein the operating element has a rotatable spindle which runs essentially parallel to the sole and transversely to the longitudinal direction of the boot body, with two opposite-running threads, and the support elements are designed as running nuts located on the spindle.

6. The ski boot as claimed in claim 5, wherein stopping means for one support element is provided on the spindle in the area of a longitudinal center plane of the boot.

7. The ski boot as claimed in claim 6, wherein the stopping means of the spindle comprises a stop formed by a step between the first section and the second section of the spindle, the step formed by one section having a diameter larger than the other section and the sets of threads provided on both sections have the same pitch.

8. The ski boot as claimed in claim 5, wherein the spindle is rotatably and rigidly mounted on the shaft, and the shaft has in the area of one end of the spindle a passage for turning the spindle from outside the boot body.

9. The ski boot as claimed in claim 8, wherein the spindle is removably mounted at one end in the passage and at the other end in a bearing member.

10. The ski boot as claimed in claim 1, wherein inclined surfaces are provided on each of the camming surfaces attached to the foot-bed and the camming surfaces of the camming means.

11. The ski boot as claimed in claim 10, wherein the foot-bed has support ribs which protect in the direction towards the sole, run transversely to the longitudinal direction of the boot, are wedge-shaped and on which said camming surfaces attached to the foot-bed are provided.

12. The ski boot as claimed in claim 11, wherein each camming surface attached to the foot-bed is defined by a plurality of part surfaces which are defined by an inclined area of the wedge-shaped support ribs, respectively, and which are separated from one another in the longitudinal direction of the boot body, the plurality of part surfaces of each camming surface attached to the foot-bed being supported on a common one of said support elements.

13. The ski boot as claimed in claim 12, wherein the support elements are essentially of cuboid design and bear against the sole, said camming surfaces of the support elements comprising support surfaces which correspond to said part surfaces which are separated from one another by retaining noses which engage between the support ribs.

14. A ski boot with a height-adjustable foot-bed, comprising:

a boot body including a shaft and a sole;

a foot-bed; and a foot-bed support means;- wherein said foot-bed is arranged within the boot body to bear in a heel area thereof against said support means, the support means comprising camming means displaceable within the boot body by displacement means operable from outside the boot body for adjustment of the height of the foot-bed;

the camming means comprising a first and a second support element, the two support elements mutually offset and displaceable in a direction transverse to a longitudinal direction of the boot body, each support element having a camming surface which cooperates with a corresponding camming surface attached to the foot-bed, at least one of each camming surface of the camming means and each camming surface attached to the foot-bed comprising an inclined surface inclined in a direction of displacement of the support elements;

the displacement means comprising a rotatable spindle which runs essentially parallel to the sole and transversely to the longitudinal direction of the boot body, and the support elements being running nuts located on the spindle; and the spindle comprising a first section having a first diameter and a first set of threads; a second section having a second diameter and a second set of threads; the first and second sets of threads running in opposite directions; stopping means being located between the first and second sections of the spindle for preventing at least one support element from traveling the entire length of the spindle, wherein an inner surface of a stopped support element in its stopped position defines a vertical plane through a longitudinal center line of the boot body.

15. A ski boot with a height-adjustable foot-bed, comprising:

a boot body including a shaft and a sole;

a foot-bed; and a foot-bed support means; wherein said foot-bed is arranged within the boot body to bear in a heel area thereof against said support means, the support means comprising camming means displaceable within the boot body by displacement means operable from outside the boot body for adjustment of the height of the foot-bed;

the camming means comprising a first and a second support element, the two support elements mutually offset and displaceable in a direction transverse to a longitudinal direction of the boot body, each support element having a camming surface which cooperates with a corresponding camming surface attached to the foot-bed, at least one of each camming surface of the camming means and each camming surface attached to the foot-bed comprising an inclined surface inclined in a direction of displacement of the support elements;

the displacement means comprising a rotatable spindle which runs essentially parallel to the sole and transversely to the longitudinal direction of the boot body, and the support elements being running nuts located on the spindle;

the spindle being rotatable and rigidly mounted on the shaft and comprising a first section having a first diameter and a first set of threads; a second section having a second diameter and a second set of threads; the first and second sets of threads running in opposite directions; stopping means being located between the first and second sections of the spindle for preventing at least one support element from traveling the entire length of the spindle, wherein an inner surface of a stopped support element in its stopped position defines a vertical plane through a longitudinal center line of the boot body.

the shaft having a passage defined in the area of one end of the spindle for turning the spindle from outside the boot body, and bearing member; and the spindle being removably mounted at one end in the passage and at the other end in the bearing members.

* * * * *